US008742746B1

(12) United States Patent
Abernethy

(10) Patent No.: US 8,742,746 B1
(45) Date of Patent: Jun. 3, 2014

(54) ULTRA LOW-NOISE TRUE SUB-VOLT BAND GAP

(75) Inventor: Brian Abernethy, Escondido, CA (US)

(73) Assignee: Applied Micro Circuits Corporation, Sunnyvale, CA (US)

( * ) Notice: Subject to any disclaimer, the term of this patent is extended or adjusted under 35 U.S.C. 154(b) by 0 days.

(21) Appl. No.: 13/454,973

(22) Filed: Apr. 24, 2012

(51) Int. Cl.
*G05F 3/16* (2006.01)

(52) U.S. Cl.
USPC ..... 323/313

(58) Field of Classification Search
USPC ..... 323/311, 312, 313, 314, 315, 316, 317, 323/907
See application file for complete search history.

(56) References Cited

U.S. PATENT DOCUMENTS 6,075,354 A * 6/2000 Smith et al. ..... 323/313
6,930,538 B2 * 8/2005 Chatal ..... 327/539
7,199,646 B1 * 4/2007 Zupcau et al. ..... 323/314
7,342,390 B2 * 3/2008 Tachibana et al. ..... 323/316
7,576,598 B2 * 8/2009 Marinca ..... 323/314
2009/0140792 A1 * 6/2009 Horie ..... 327/513
2010/0052644 A1 * 3/2010 Ide ..... 323/313

* cited by examiner

*Primary Examiner* — Gary L Laxton
*Assistant Examiner* — Alex Torres-Rivera

(57) ABSTRACT

A method and device are disclosed for providing an ultra low-noise hand gap voltage reference. The method detects a first voltage drop across a first diode reference, and a second voltage drop across a second voltage reference that includes a second diode. The first and second voltage drops are compared. Temperature compensation currents are supplied to the first diode reference and second voltage references in addition to constant currents, where the constant currents have the same value across a first temperature range. As a result of the constant current, a minimal amount of temperature compensation current is required. Alternatively stated, temperature compensation current is provided having a rate of change greater than PTAT. In response to comparing the first voltage drop to the second voltage drop, a true sub-volt hand gap voltage is supplied across a third voltage reference including a diode, that is constant across the first temperature range.

20 Claims, 4 Drawing Sheets

ULTRA LOW-NOISE TRUE SUB-VOLT BAND GAP

BACKGROUND OF THE INVENTION

1. Field of the Invention

This invention generally relates to electronic circuitry and, more particularly, to a system and method for an ultra low noise band gap reference voltage.

2. Description of the Related Art

Band gap—A well-known circuit used to provide a stable voltage reference;

PTAT—Proportional To Absolute Temperature; Band gap circuits generate a current that varies with the absolute value of the ambient temperature.

gm—transconductance of FETs and bipolar transistors;

C—Degrees Celsius;

K—Degrees Kelvin=C+273=absolute temperature.

As noted in Wikipedia, a bandgap voltage reference is a temperature independent voltage reference circuit widely used in integrated circuits, usually with an output voltage close to the theoretical 1.22 eV bandgap of silicon at 0 K. The voltage difference between two p-n junctions (e.g. diodes), operated at different current densities, is used to generate a proportional to absolute temperature (PTAT) current in a first resistor. This current is used to generate a voltage in a second resistor. This voltage in turn is added to the voltage of one of the junctions (or a third one, in some implementations). The voltage across a diode operated at constant current, or here with a PTAT current, is complementary to absolute temperature (CTAT—reduces with increasing temperature), with approx. −2 mV/K. If the ratio between the first and second resistor is chosen properly, the first order effects of the temperature dependency of the diode and the PTAT current cancel out. The resulting voltage is about 1.2-1.3 V, depending on the particular technology and circuit design, and is close to the theoretical 1.22 eV bandgap of silicon at 0 K. The remaining voltage change over the operating temperature of typical integrated circuits is on the order of a few millivolts. This temperature dependency has a typical parabolic behavior.

Because the output voltage is by definition fixed around 1.25 V for typical bandgap reference circuits, the minimum operating voltage is about 1.4 V, as in a CMOS circuit, at least one drain-source voltage of a FET (field effect transistor) has to be added. Therefore, recent work concentrates on finding alternative solutions, in which for example currents are summed instead of voltages, resulting in a lower theoretical limit for the operating voltage.

FIG. 1 is a schematic diagram of a low voltage band gap circuit (prior art). The circuit provides a reference current that tracks R2 and is relatively flat over temperature. The reference current, I3, can either be used directly as a bias current source or applied to a grounded resistor, and the voltage drop across the resistor can be used as a reference voltage. The minimum supply voltage is the voltage across diode D(1), plus VDSsat of the PFETs I1 or I2. This voltage can be as low as just under a volt.

The main disadvantage of this circuit is that it is noisy. The signal is the voltage drop across R2, which is equal to 26 mV*ln(N). The noise is the thermal noise across R2, which is the square root (sqrt) of (4 ktR) root mean squared (RMS), summed with the equivalent input noise of the amp RMS, and summed with the current noise of the current source FETs (sqrt(4*(⅔(kT*gm)))).

Since the signal is relatively small (26 mv*ln(N)), the noise of this circuit is considerable. The only way to reduce the noise in an integrated solution is to increase the current and area of the circuit. There are many variations of this circuit design.

FIG. 2 is a schematic drawing of a band gap circuit variation (prior art). The minimum supply voltage is the band gap voltage, 1.21V, plus the VDSsat of the current source FET 13. Thus, this circuit requires a supply voltage of over 1.3V. Though the current produced by this circuit has the same approximate noise level as the typical low voltage band gap circuit, the output voltage has a reduced noise level. The reason is that the output voltage noise is the current noise times the effective AC resistance of the load. With a typical low voltage bandgap circuit, the AC resistance of the load is simply the load resistance value. However, for a design like the circuit of FIG. 2, the AC resistance of the load is R3 plus 1/gm of the diode D.

For example, if I3 is 25 uA and the voltage is 810 mv, then R3 is 16K ohms and 1/gm of diode D=1540 ohms. So, the effective AC resistance is 17.54K ohms. However, if the same voltage level is provided by the low voltage band gap circuit of FIG. 1, the required resistance would be 1.21V/25 uA or 48.4 K ohms. Therefore, the band gap voltage reference of FIG. 2 is approximately 2.7 times lower in noise.

It would be advantageous if a band gap reference voltage circuit could be designed that operated at a low supply voltage, while supplying a low noise reference voltage.

SUMMARY OF THE INVENTION

Disclosed herein is a hand gap circuit that addresses the above-mentioned problems. According to well understood and practiced band gap design, the current generated by the band gap is proportional to absolute temperature (PTAT) in nature, and so it rises with temperature. The band gap circuit disclosed herein sums some flat-over-temperature current with temperature compensated current, and provides the summed current to the input of an operational amplifier (op amp). Since the op amp ensures that the two diode loads on its inputs are receiving PTAT current, the temperature compensated current is a super PTAT current. That is, the current increases at a rate even greater than the absolute temperature.

Accordingly, a method is disclosed for providing an ultra low-noise hand gap voltage reference. The method detects a first voltage drop across a first diode reference, and a second voltage drop across a second voltage reference that includes a second diode. The first and second voltage drops are compared. Temperature compensation currents are supplied to the first diode reference and second voltage references in addition to constant currents, where the constant currents have the same value across a first temperature range. As a result of the constant current, a minimal amount of temperature compensation current is required. Alternatively stated, temperature compensation current is provided having a rate of change greater than PTAT. In response to comparing the first voltage drop to the second voltage drop, a hand gap voltage is supplied across a third voltage reference including a diode, that is constant across the first temperature range.

Additional details of the above-described method and an ultra low-noise band gap voltage reference device are provided below.

DETAILED DESCRIPTION

Figure 3:
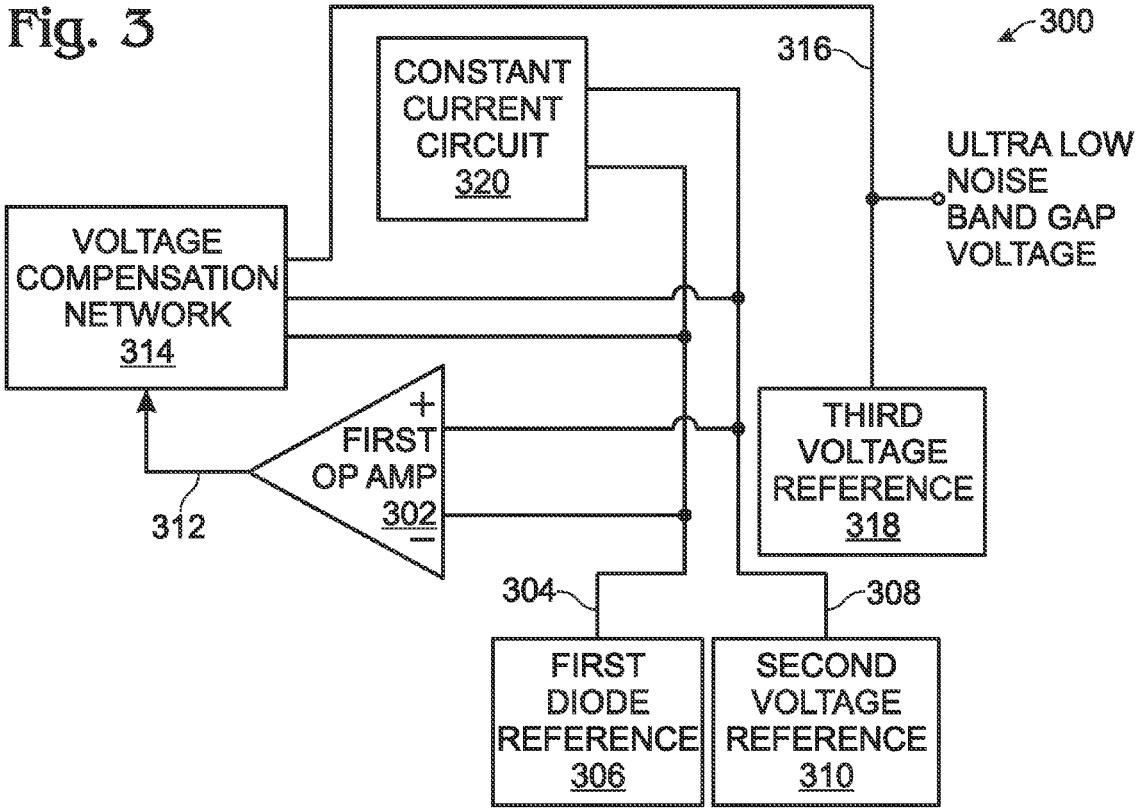
FIG. 3 is a schematic drawing of an ultra low-noise band gap voltage reference device.

FIG. 3 is a schematic drawing of an ultra low-noise hand gap voltage reference device. The device 300 comprises a first operational amplifier (op amp) 302 having a negative input on line 302 connected to a first diode reference 306. The op amp 302 has a positive input on line 308 connected to a second voltage reference 310 including a diode, and an output on line 312. A voltage compensation network 314 has an input connected to the first op amp output on line 312, a first output on line 304 to supply current to the first diode reference 306 in an inverse relationship to a first voltage across the first diode reference. That is, the current increases as the first voltage decreases. The voltage compensation network 314 has a second output on line 308 to supply current to the second voltage reference 310 in an inverse relationship to a second voltage across the second voltage reference. The voltage compensation network 314 has an output on line 316 connected a third voltage reference 318 including a diode, to supply hand gap current having a constant band gap reference voltage across a first temperature range.

A constant current circuit 320 has a first output connected on line 304 to the first diode reference 306, to supply a first current that is constant across the first temperature range. Likewise, the constant current circuit 320 has a second output on line 308 connected to the second voltage reference 310 to supply a second current that is constant across the first temperature range. The first op amp 302 supplies an output on line 312 having a constant voltage across the first temperature range.

Advantageously, as explained in more detail below, the band gap voltage reference device is a true sub-voltage band gap reference. Further, as is well known in the art but not shown, the band gap voltage reference device may require a start-up circuit upon initialization, Bandgap circuits typically have two stable states, the desired operating state, and a state with zero current flowing. Hence, a startup circuit is needed that senses if the circuit is in the zero current state, and if it is, kick starts it into the desired operating state. Then, when the start-up circuit senses circuit flow in the band gap reference circuit, the startup circuit shuts itself off.

Figure 4:
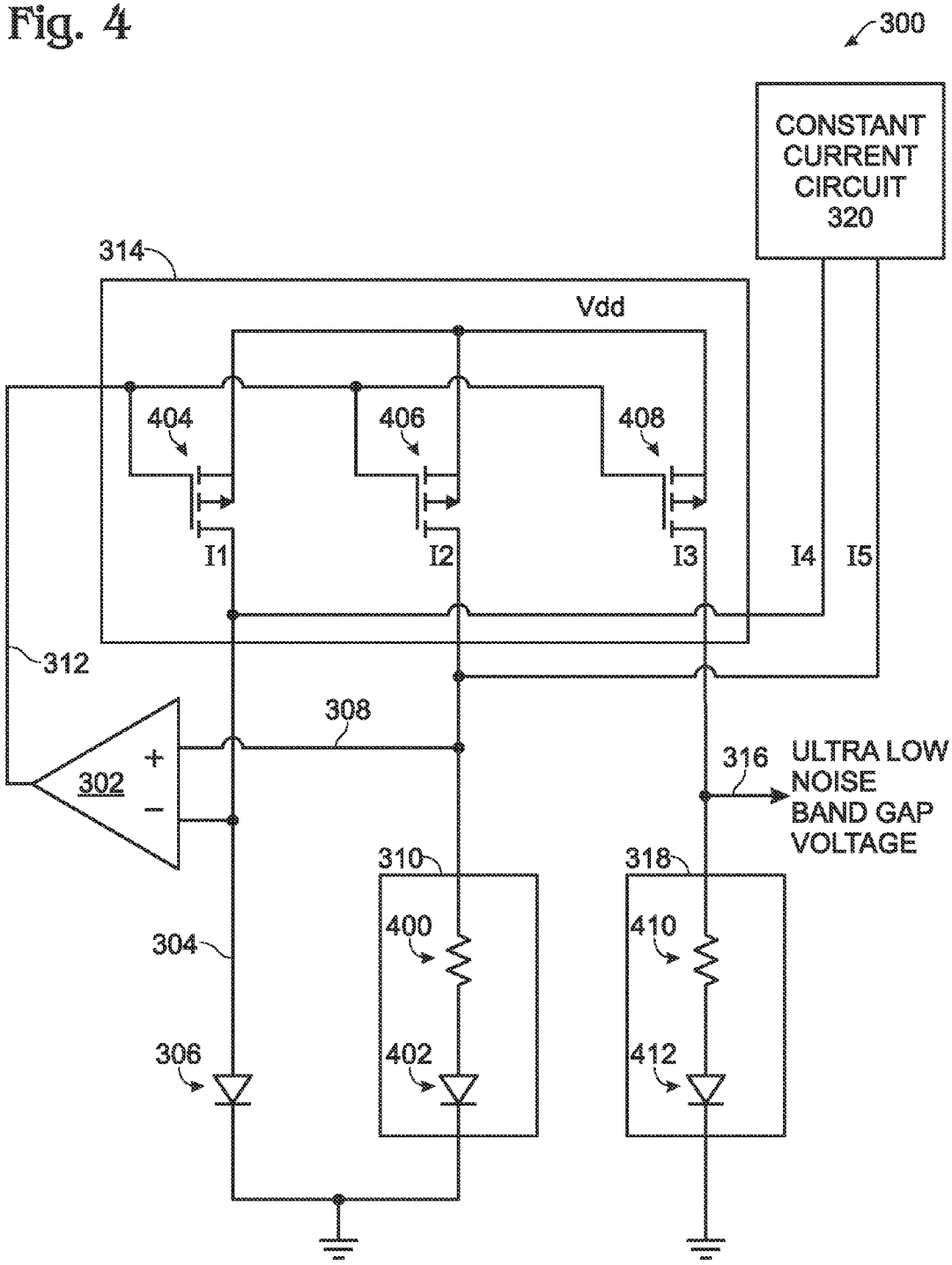
FIG. 4 is a schematic drawing depicting the hand gap voltage reference device of FIG. 3 in greater detail.

FIG. 4 is a schematic drawing depicting the band gap voltage reference device of FIG. 3 in greater detail. The first diode reference comprises a first diode 306 having an anode connected to the first op amp negative input on line 304 and a cathode connected to a first supply voltage. Here, the first supply voltage is shown as ground. The second voltage reference voltage 310 comprises a first resistor 400 having a first terminal connected to the first op amp positive input on line 306, and a second terminal. A second diode 402 has an anode connected to the second terminal of the first resistor 400, and a cathode connected to the first supply voltage. Alternatively but not shown, the series order of the first resistor and second diode may be reversed.

In one aspect, the voltage compensation network 314 comprises a first field effect transistor (FET) 404 having a gate connected to the first op amp output on line 312, a drain connected to the first op amp negative input on line 304, and a source connected to a second supply voltage having a higher potential than the first supply voltage. Here, the second supply voltage is shown as Vdd. A second FET 406 has a gate connected to the first op amp output on line 312, and drain connected to the first op amp positive input on line 308, and a source connected to the second supply voltage. A third FET 408 has a gate connected to the first op amp output on line 312, a source connected to the second supply voltage, and a drain to supply the hand gap current on line 316.

The third voltage reference 318 comprises a second resistor 410 having a first terminal connected to the drain of the third FET 408, and a second terminal. A third diode 412 has an anode connected to the second terminal of the second resistor 410, and a cathode connected to the first supply voltage. The order of the third diode and second resistor may be reversed.

In one aspect, the ratio of the maximum to minimum currents supplied by the first and second outputs of the voltage compensation network on lines 304 and 308, over the first temperature range, are, respectively, greater than 5. The minimum currents are supplied at the low end of the temperature range. In one aspect, the first temperature range is −20 degrees C. to 110 degrees C.

Seen from another perspective, the voltage compensation network 314 provides temperature compensation currents on line 304 and 308 that change at a rate greater than proportional to absolute temperature (PTAT), while the first diode reference 306 and second voltage reference 310 each accept PTAT currents. Likewise, the voltage compensation network 314 supplies a band gap current that changes at a rate greater than PTAT.

Figure 5:
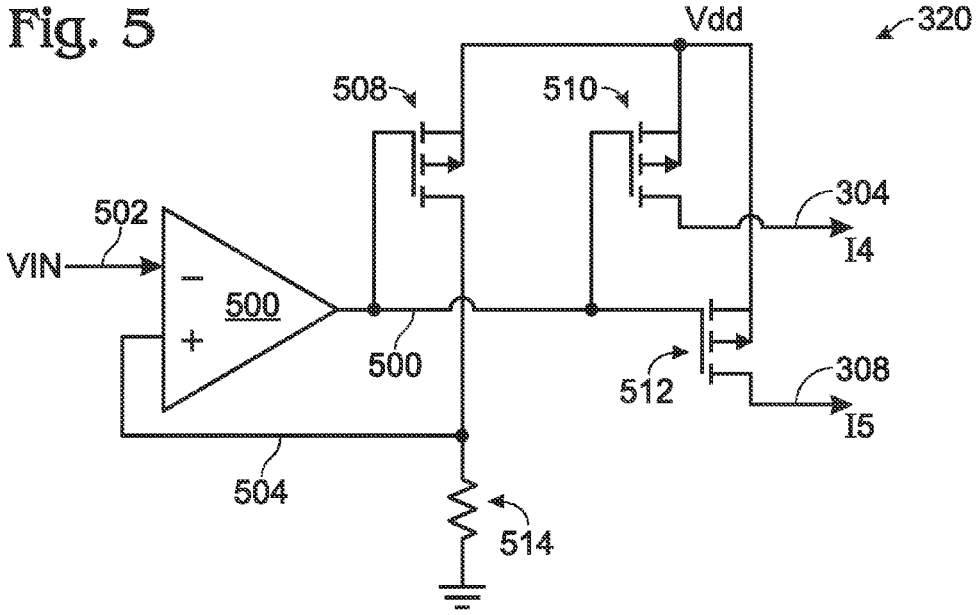
FIG. 5 is a schematic drawing depicting an exemplary constant current circuit.

FIG. 5 is a schematic drawing depicting an exemplary constant current circuit. The constant current circuit 320 comprises a second op amp 500 having a negative input on line 502 connected to a bias voltage (Vin), a positive input on line 504, and an output on line 506. A fourth FET 508 has a gate connected to the second op amp output on line 506, a source connected to the second supply voltage (i.e. Vdd), and a drain connected to line 504. A fifth FET 510 has a gate connected to the second op amp output on line 506, a source connected to the second supply voltage, and a drain connected to the anode of the first diode on line 304. A sixth FET 512 has a gate connected to the second op amp output on line 506, a source connected to the second reference voltage, and a drain connected to the first terminal of the first resistor on line 308. A third resistor 514 has a first terminal connected to the positive input of the second op amp and the drain of the fourth FET on line 504, and a second terminal connected to the first supply voltage (i.e. ground). The current supplied on lines 304 and 308 is equal to Vin divided by the resistance of the third resistor 514. In one aspect, the voltage Vin may be the band gap voltage (see FIG. 3 or 4, line 316), or a derivative of the hand gap voltage. The circuit described is just one example of a voltage-to-current generator. A number of equivalent circuits are known in the art that would enable the ultra low noise band gap reference device.

Functional Description

As is well understood, the current used by a band gap reference circuit is PTAT in nature, so it rises with temperature. The device of FIGS. 3 and 4 sums currents that remains flat over temperature current with temperature compensated currents. Since the op amp ensures that the two diode loads on its inputs are receiving PTAT current, the current sources are producing a super PEAT current that increases at a rate even greater than the absolute temperature.

For example, if the temperature is swept from −20 C to 27 C, to 110 C, the absolute temperatures are 253K to 300K to 383K. The relative currents are 84%, 100%, and 128% respectively. A flat-over-temperature (constant) current can be summed with the temperature compensated current, with the constant current being nearly equal to the lowest expected operating current. For example, at −20 C the constant current may be 74% of the required current. Now, the super PTAT current supplied by the voltage compensation network is 10% at −20 C, 26% at 27 C, and 54% at 110 C, see Table 1. The ratio of the greatest current provided by the voltage compensation network divided by the least current is 5.4, rather than 1.52, as would have been required if no constant current is used.

TABLE 1

| Degrees Celsius | Degrees Kelvin | PTAT Current | Fixed Current | Super PTAT Current |
|---|---|---|---|---|
| −20 | 253 | 84% | 74% | 10% |
| 27 | 300 | 100% | 74% | 26% |
| 110 | 383 | 128% | 74% | 54% |

Figure 2:
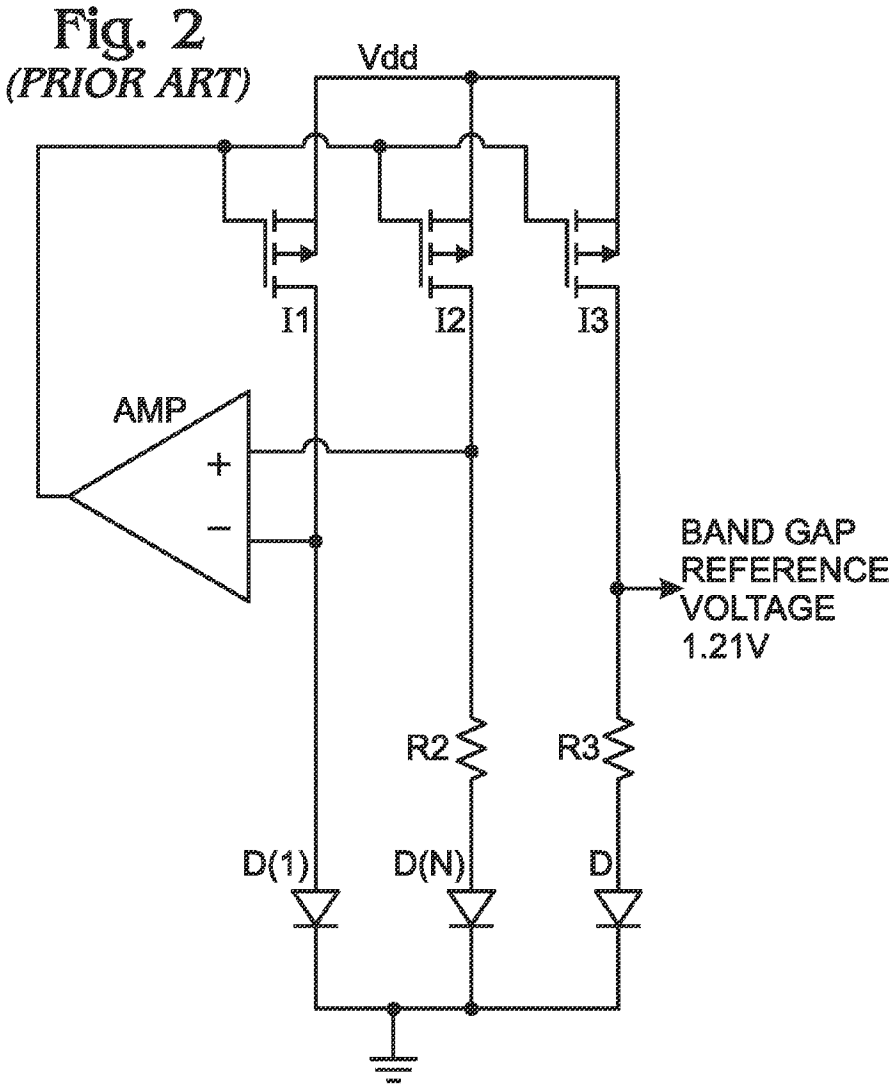
Fig. 2 (PRIOR ART)
FIG. 2 is a schematic drawing of a hand gap circuit variation (prior art).

Since the temperature compensation current variation is now about 3.5 times greater than before, the resistor forming the ultra low band gap voltage can be 3.5 times lower in value. As compared to the resistance required for the circuit of FIG. 2, the resistance of the second resistor 410 (see FIG. 4) can be dropped from 16K ohms to about 4.5K. The resulting band gap voltage is 810 mV, plus 25 uA times 4.5K ohms, or 922 mV. In addition, by making the load diode 412 larger, the output voltage can be further lowered, since the band gap current is no longer PTAT. If the AC load of the low voltage circuit (FIG. 1) is 48.4K ohms and the equivalent load of FIG. 2 is 17.54K ohms, the equivalent AC load of FIG. 4 (resistor 410) is 6.04K ohms, see Table 2. After correcting for the smaller signal (922 mV instead of 1.21V), the current of FIG. 4 drives an equivalent 7.9K ohms, which is 6.1 times less than the circuit of FIG. 1 and 2.2 times lower than the circuit of FIG. 2. By using large diodes operating at low current densities, the ultra low band gap voltage can be made as low as 800 mV, or lower.

TABLE 2

Figure 1:
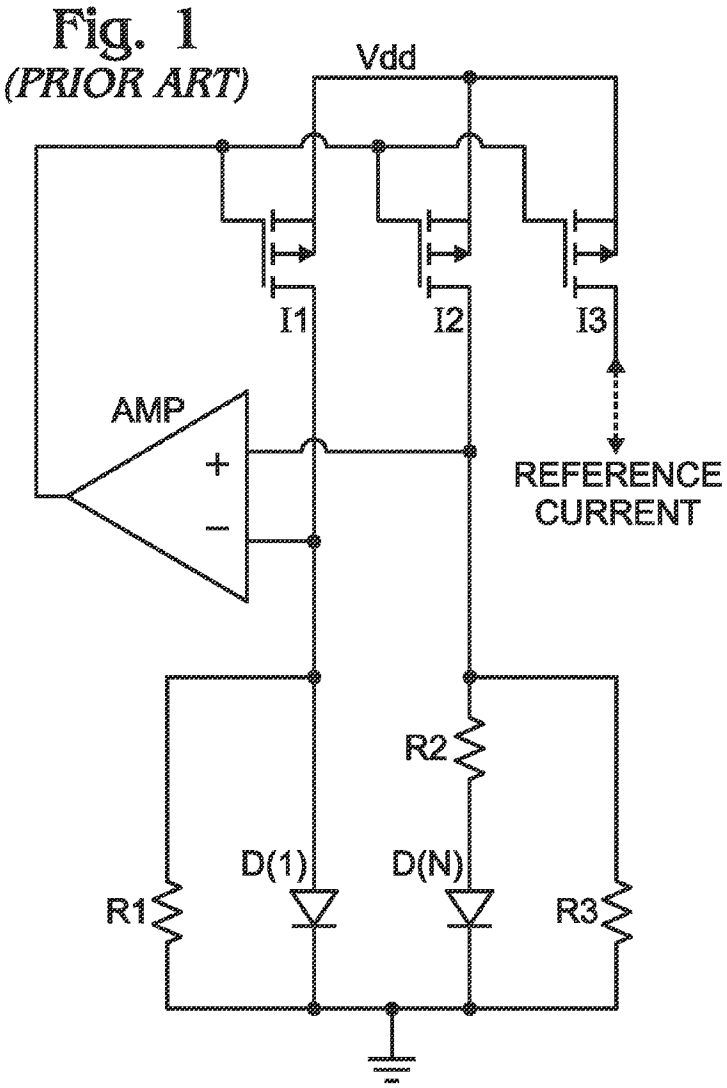
Fig. 1 (PRIOR ART)
FIG. 1 is a schematic diagram of a low voltage band gap circuit (prior art).

| | Output AC impedance | Multiplier to get 1.21 V | Relative Noise |
|---|---|---|---|
| FIG. 1 circuit | 48.4K | 1 | 100% |
| FIG. 2 circuit | 17.54K | 1 | 36% |
| FIG. 3 circuit | 6.04K | 1.31 | 16% |

Figure 6:
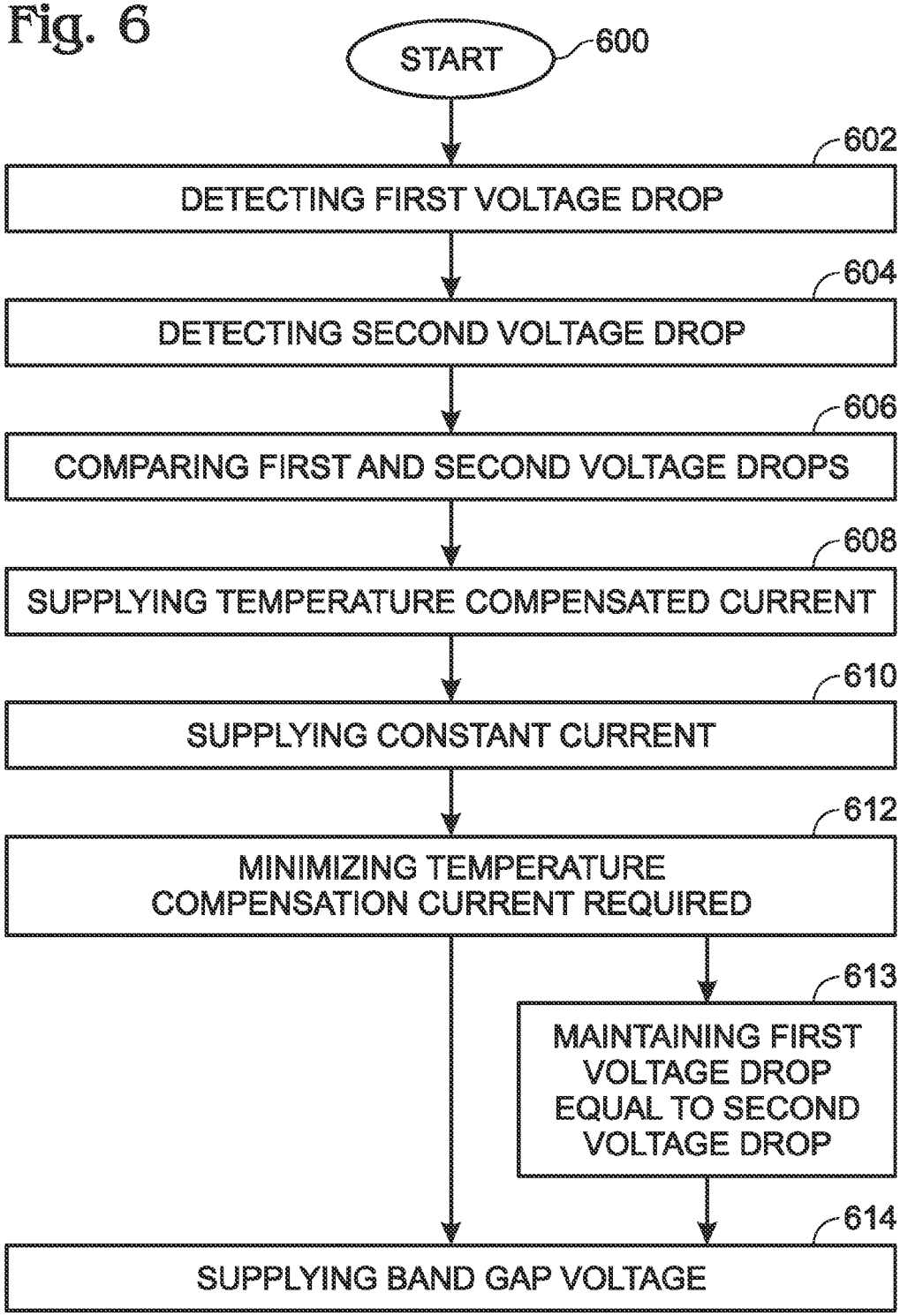
FIG. 6 is a flowchart illustrating a method for providing an ultra low-noise band gap voltage reference.

FIG. 6 is a flowchart illustrating a method for providing an ultra low-noise hand gap voltage reference. Although the method is depicted as a sequence of numbered steps for clarity, the numbering does not necessarily dictate the order of the steps. It should be understood that some of these steps may be skipped, performed in parallel, or performed without the requirement of maintaining a strict order of sequence. Generally however, the method follows the numeric order of the depicted steps. The method starts at Step 600.

Step 602 detects a first voltage drop across a first diode reference. Step 604 detects a second voltage drop across a second voltage reference including a second diode. Step 606 compares the first and second voltage drops. Step 608 supplies temperature compensation current to the first diode reference and second voltage reference. In one aspect, the ratio of maximum to minimum temperature compensation currents over a first temperature range is, respectively, greater than 5. In another aspect, the first temperature range is −20 degrees C. to 110 degrees C., and the minimum temperature compensation current is supplied at the low end of the temperature range.

In addition to the temperature compensation current supplied in Step 608, Step 610 supplies a constant current to each of the first diode reference and second voltage reference, where the constant currents have the same value across the first temperature range. In response to the constant current. Step 612 minimizes the temperature compensation current required. In response to comparing the first voltage drop to the second voltage drop, Step 614 supplies a band gap voltage across a third voltage reference including a diode, that is constant across the first temperature range.

In response to the combination of constant currents (Step 610) and temperature compensation currents (Step 608), Step 613 maintains the first voltage drop equal to the second voltage drop. In one aspect, minimizing the temperature compensation current required in Step 612 includes providing temperature compensation currents that change at a rate greater than proportional to absolute temperature (PTAT). Then, maintaining the first voltage drop equal to the second voltage drop in Step 613 includes supplying PTAT currents to the first diode reference and second voltage reference.

In another aspect, comparing the first and second voltage drops in Step 606 includes providing a first op amp having a negative input connected to a first diode reference, a positive input connected to a second voltage reference, and an output. In one aspect, supplying temperature compensation current in Step 608 includes providing a first FET having a gate connected to the first op amp output, a drain connected to the first op amp negative input, and a source connected to a second supply voltage having a higher potential than a first supply voltage, see FIG. 4. The step also provides a second FET having a gate connected to the first op amp output, and drain connected to the first op amp positive input, and a source connected to the second supply voltage. Then, supplying the hand gap voltage in Step 614 includes providing a third FET having a gate connected to the first op amp output, a source connected to the second supply voltage, and a drain to supply the hand gap current to the third voltage reference.

In another aspect, detecting the second voltage drop across the second voltage reference in Step 604 includes providing a first resistor having a first terminal connected to the first op amp positive input, and a second terminal. The step also provides a second diode having an anode connected to the second terminal of the first resistor, and a cathode connected to the first supply voltage. Then, supplying the band gap voltage across the third voltage reference in Step 614 includes providing the third voltage reference as follows. A second resistor has a first terminal, connected to the drain of the third FET, and a second terminal. A third diode has an anode connected to the second terminal of the second resistor, and a cathode connected to the first supply voltage.

In another aspect, supplying the constant current to the first diode reference and second voltage reference in Step 610 includes providing a second op amp having a negative input connected to a bias voltage, a positive input, and an output. A fourth FET has a gate connected to the second op amp output, a source connected to the second supply voltage, and a drain. A fifth FET has a gate connected to the second op amp output, a source connected to the second supply voltage, and a drain connected to the anode of the first diode. A sixth FET has a gate connected to the second op amp output, a source connected to the second supply voltage, and a drain connected to the first terminal of the first resistor. A third resistor has a first terminal connected to the positive input of the second op amp and the drain of the fourth FET, and a second terminal connected to the first supply voltage.

A system and method have been provided for an ultra low noise band gap voltage reference. Examples of circuits and components have been presented to illustrate the invention. However, the invention is not limited to merely these examples. Other variations and embodiments of the invention will occur to those skilled in the art.

I claim:

1. A band gap voltage reference device comprising:

a first operational amplifier (op amp) having a negative input connected to a first diode reference, a positive input connected to a second voltage reference including a second diode, and an output;

a voltage compensation network having an input connected to the first op amp output, a first output to supply current to the first diode reference, a second output to supply current to the second voltage reference, and a third output connected to a third voltage reference including a third diode, to supply band gap current having a constant band gap reference voltage across a first temperature range; and, a constant current circuit having a first output connected between the voltage compensation network and the first diode reference to supply a first current that is constant across the first temperature range, and the constant current circuit having a second output connected between the voltage compensation network and the second voltage reference to supply a second current that is constant across the first temperature range, wherein the constant current circuit is uncompensated for temperature variations.

2. The device of claim 1 wherein the first op amp output supplies a constant voltage across the first temperature range.

3. The device of claim 1 wherein the first diode reference comprises an anode connected to the first op amp negative input and a cathode connected to a first supply voltage;

wherein the second voltage reference voltage comprises:

a first resistor having a first terminal connected to the first op amp positive input, and a second terminal; and, wherein the second diode of the second voltage reference comprises an anode connected to the second terminal of the first resistor, and a cathode connected to the first supply voltage.

4. The device of claim 3 wherein the voltage compensation network comprises:

a first field effect transistor (FET) having a gate connected to the first op amp output, a drain connected to the first op amp negative input, and a source connected to a second supply voltage having a higher potential than the first supply voltage;

a second FET having a gate connected to the first op amp output, and drain connected to the first op amp positive input, and a source connected to the second supply voltage; and, a third FET having a gate connected to the first op amp output, a source connected to the second supply voltage, and a drain to supply the band gap current.

5. The device of claim 4 wherein the third voltage reference comprises:

a second resistor having a first terminal connected to the drain of the third FET, and a second terminal;

wherein the third diode of the third voltage reference comprises an anode connected to the second terminal of the second resistor, and a cathode connected to the first supply voltage.

6. The device of claim 5 wherein the constant current circuit comprises:

a second op amp having a negative input connected to a bias voltage, a positive input, and an output;

a fourth FET having a gate connected to the second op amp output, a source connected to the second supply voltage, and a drain;

a fifth FET having a gate connected to the second op amp output, a source connected to the second supply voltage, and a drain connected to the anode of the first diode;

a sixth FET having a gate connected to the second op amp output, a source connected to the second reference voltage, and a drain connected to the first terminal of the first resistor; and, a third resistor having a first terminal connected to the positive input of the second op amp and the drain of the fourth FET, and a second terminal connected to the first supply voltage.

7. The device of claim 1 wherein a ratio of a maximum to minimum current supplied by the first and second outputs of the voltage compensation network over the first temperature range are, respectively, greater than 5.

8. The device of claim 1 wherein the voltage compensation network supplies the band gap current that changes at a rate greater than proportional to absolute temperature (PTAT).

9. The device of claim 1 wherein the voltage compensation network first and second outputs supply a minimum current at the low end of the first temperature range.

10. The device of claim 1 wherein the voltage compensation network provides temperature compensation currents that change at a rate greater than PTAT; and, wherein the first diode reference and second voltage reference each accept PTAT currents.

11. A method for providing a band gap voltage reference, the method comprising:

detecting a first voltage drop across a first diode reference;

detecting a second voltage drop across a second voltage reference including a second diode;

comparing the first and second voltage drops;

supplying temperature compensation current to the first diode reference and second voltage reference;

in addition to the temperature compensation current, supplying a constant current to each of the first diode reference and the second voltage reference, where the constant currents have the same value across a first temperature range, and wherein the constant currents are uncompensated for temperature variations;

in response to the constant current, minimizing the temperature compensation current required; and, in response to comparing the first voltage drop to the second voltage drop, supplying a band gap voltage across a third voltage reference including a diode, that is constant across the first temperature range.

12. The method of claim 11 wherein comparing the first and second voltage drops includes providing a first operational amplifier (op amp) having a negative input connected to a first diode reference, a positive input connected to a second voltage reference, and an output.

13. The method of claim 11 wherein supplying temperature compensation current includes providing:

a first field effect transistor (FET) having a gate connected to the first op amp output, a drain connected to the first op amp negative input, and a source connected to a second supply voltage having a higher potential than a first supply voltage;

a second FET having a gate connected to the first op amp output, and drain connected to the first op amp positive input, and a source connected to the second supply voltage; and, wherein supplying the band gap voltage includes providing a third FET having a gate connected to the first op amp output, a source connected to the second supply voltage, and a drain to supply the band gap current to the third voltage reference.

14. The method of claim 13 wherein detecting the second voltage drop across the second voltage reference includes providing:

a first resistor having a first terminal connected to the first op amp positive input, and a second terminal;

a second diode having an anode connected to the second terminal of the first resistor, and a cathode connected to the first supply voltage;

wherein supplying the band gap voltage across the third voltage reference includes providing the third voltage reference as follows:

a second resistor having a first terminal connected to the drain of the third FET, and a second terminal;

a third diode having an anode connected to the second terminal of the second resistor, and a cathode connected to the first supply voltage.

15. The method of claim 14 wherein supplying the constant current to the first diode reference and second voltage reference includes providing:

a second op amp having a negative input connected to a bias voltage, a positive input, and an output;

a fourth FET having a gate connected to the second op amp output, a source connected to the second supply voltage, and a drain;

a fifth FET having a gate connected to the second op amp output, a source connected to the second supply voltage, and a drain connected to the anode of the first diode;

a sixth FET having a gate connected to the second op amp output, a source connected to the second supply voltage, and a drain connected to the first terminal of the first resistor; and, a third resistor having a first terminal connected to the positive input of the second op amp and the drain of the fourth FET, and a second terminal connected to the first supply voltage.

16. The method of claim 11 wherein the ratio of maximum to minimum temperature compensation currents over the first temperature range, are respectively, greater than 5.

17. The method of claim 16 wherein the first temperature range is −20 degrees C. to 110 degrees C.

18. The method of claim 11 wherein the temperature compensation currents are each a minimum current at the low end of the first temperature range.

19. The method of claim 11 further comprising:

in response to the combination of constant currents and temperature compensation currents, maintaining the first voltage drop equal to the second voltage drop.

20. The method of claim 19 wherein minimizing the temperature compensation current required includes providing temperature compensation currents that change at a rate greater than proportional to absolute temperature (PTAT); and, wherein maintaining the first voltage drop equal to the second voltage drop in response to the combination of constant and temperature compensation currents includes supplying PTAT currents to the first diode reference and second voltage reference.

* * * * *